United States Patent [19]

Black, III et al.

[11] Patent Number: 4,563,551

[45] Date of Patent: Jan. 7, 1986

[54] ELECTRICAL SWITCH HAVING ASSURED LOW-RESISTANCE ELECTRICAL CONTACT BETWEEN TERMINAL RIVETS AND CONTACT PLATES

[75] Inventors: Charles E. Black, III, Mount Prospect; John W. Habecker, Zion, both of Ill.

[73] Assignee: Indak Manufacturing Corp., Northbrook, Ill.

[21] Appl. No.: 689,830

[22] Filed: Jan. 9, 1985

[51] Int. Cl.[4] ..... H01H 15/00; H01H 1/00

[52] U.S. Cl. ..... 200/16 C; 200/284

[58] Field of Search ..... 200/16 C, 16 D, 16 E, 200/16 F, 284, 61.86

[56] References Cited

U.S. PATENT DOCUMENTS

| | | | |
|---|---|---|---|
| 3,223,794 | 12/1965 | Hoy et al. | 200/16 C |
| 3,319,016 | 5/1967 | Hoy et al. | 200/16 C |
| 3,378,654 | 4/1968 | Hoy et al. | 200/16 C |
| 3,614,702 | 10/1971 | Vargas | 200/284 X |
| 3,721,779 | 3/1973 | Raab | 200/16 C |
| 4,168,405 | 9/1979 | Raab et al. | 200/16 C X |

*Primary Examiner*—J. R. Scott

*Attorney, Agent, or Firm*—Burmeister, York, Palmatier, Hamby & Jones

[57] ABSTRACT

The switch has at least one contact plate, mounted on the inner side of an insulating wall forming one side of a casing. The contact plate has a contact rail or some other contact element which is engageable by a contactor on a movable carriage within the casing. The contact plate has a mounting hole surrounded by a circular flange extruded from or otherwise formed in one piece with the contact plate. A terminal bar is mounted against the outer side of the insulating wall and is connected to the contact plate by a terminal rivet, extending through the circular flange with an interference fit to establish good electrical contact therewith. The rivet also extends through an opening in the insulating wall and a mounting hole in the terminal bar. The swaging of the rivet causes the shank of the rivet to bulge outwardly, thereby expanding the circular flange and establishing a heavy interference fit between the flange and the swaged rivet, to establish and maintain low-resistance electrical contact between the flange and the rivet. Initially, the flange is preferably tapered, but is expanded by the bulging of the swaged rivet. The bulging of the swaged rivet also preferably establishes an interference fit between the rivet and the mounting hole in the terminal bar, to assure low-resistance electrical contact between the rivet and the terminal bar.

16 Claims, 24 Drawing Figures

ELECTRICAL SWITCH HAVING ASSURED LOW-RESISTANCE ELECTRICAL CONTACT BETWEEN TERMINAL RIVETS AND CONTACT PLATES

FIELD OF THE INVENTION

This invention relates generally to electrical switches and pertains particularly to multiposition electrical switches intended primarily for use on automobiles, trucks and other automotive vehicles, for applications such as the control of automotive heating and air conditioning systems.

BACKGROUND OF THE INVENTION

In certain aspects, the present invention may be regarded as an important improvement in electrical switches of the general construction disclosed and claimed in prior U.S. patents, assigned to the assignee of the present application. Such prior U.S. patents include Hoy and Hazek No. 3,223,794, issued Dec. 14, 1965; Hoy and Hazek No. 3,319,016, issued May 9, 1967; and Hoy and Hazek No. 3,378,654, issued Apr. 16, 1968.

In the general switch construction of such prior patents, some of the fixed contact members take the form of one or more conductive contact plates, mounted on the inner side of an insulating plate or wall, closing one side of a casing. A conductive contactor is movable in the casing and is engageable with the contact plate, and may also be engageable with other contact elements, such as contact points. The contactor is mounted on a carriage which is movable along a predetermined path in the casing. The carriage is operated by some external means, such as an operating lever. A spring may be provided between the carriage and the contactor, for resiliently biasing the contactor toward the contact plates and any other contact elements. In some cases, the switch may have a plurality of contact plates. The switch may also have a plurality of contactors, in some cases.

In the general switch construction of such prior patents, the contact plate or plates may have one or more contact rails, along which a contactor is slidable. The contactor may have a point or other rider, adapted to ride along two adjacent contact rails on the same contact plate or on separate contact plates.

In the general switch construction of such prior patents, the contact plates are connected to corresponding terminal bars or prongs, mounted on the outer side of the insulating wall and connected to the plates by means of rivets. Each rivet extends through a mounting hole in a contact plate, an aligned opening in the insulating wall, and an aligned mounting hole in the corresponding terminal bar. The rivet may have a head engaging the contact plate and may be swaged or upset, so as to clamp the contact plate and the terminal bar against the inner and outer sides of the insulating wall. It has been the practice in such prior switches to swage the rivet with such force that the shank of the rivet is bulged to produce an interference fit between the shank and the mounting hole in the terminal bar or prong. The interference fit establishes and maintains a good, low-resistance electrical contact between the terminal rivet and the terminal bar.

However, in certain cases, some difficulty has been experienced in establishing and maintaining a good, low-resistance electrical contact between the terminal rivet and the contact plate. The prior switches have relied upon the clamping pressure between the rivet head and the contact plate, to achieve good electrical contact. In certain cases, difficulties have been experienced in reliably establishing maintaining such clamping pressure, because there has been a tendancy for looseness to develop between the rivet head and the contact plate, due mostly to variations in the thickness of the insulating wall. Such thickness variations may be caused by changes in temperature and humidity, and also by difficulties in maintaining sufficiently close dimensional tolerances in the initial thickness of the insulating wall, particularly when such wall is in the form of an insulating plate stamped from insulating sheet material.

In the prior switch construction, any looseness between the rivet head and the contact plate tends to increase the resistance of the electrical contact therebetween. The increased resistance may cause overheating of the switch, particularly in those instances in which a high electrical current is being carried. In some cases, the overheating may be sufficiently great to damage the switch.

The present invention deals with the problem of preventing such overheating of electrical switches of this general construction, utilizing conductive contact plates.

SUMMARY OF THE INVENTION

Accordingly, a principal object of the present invention is to provide an electrical switch of the foregoing character, having a new and improved construction which assures the establishment and maintenance of good, low-resistance electrical contact between each contact plate and the corresponding terminal rivet.

A further object is to provide such a new and improved switch construction which is able to accommodate variations in the thickness of the insulating wall or plate, while still maintaining low-resistance contact between the contact plate and the terminal rivet.

In accordance with the present invention, these objects may be achieved by providing an electrical switch, comprising a casing having at least one insulating wall, a carriage movable in the casing along a predetermined path generally parallel with such insulating wall, at least one conductive contactor mounted on the carriage for movement therewith along such path, such insulating wall having inner and outer sides, contact means mounted on the inner side of such insulating wall and selectively engageable by the contactor, and terminal means connected to the contact means and projecting outwardly from the outer side of the insulating wall, such contact means including at least one conductive contact plate engageable by the contactor and having a substantially circular mounting hole in the plate with a substantially circular flange surrounding such mounting hole and formed in one piece with such contact plate, such insulating wall having an opening therein for receiving such flange, such terminal means including a terminal bar engaging the outer side of the insulating wall and having a mounting hole aligned with the mounting hole in the contact plate, and a rivet for connecting the terminal bar to the contact plate while securing the contact plate and the terminal bar to the inner and outer sides of the insulating wall, such rivet extending through the circular flange of the contact plate with an interference fit to establish and maintain good electrical contact therewith, the rivet also extending through the opening in the insulating wall and the mounting hole in the terminal bar and being swaged to establish and maintain good electrical contact with the terminal bar as well as the circular flange of the contact plate.

Preferably, the circular flange of the contact plate is initially tapered, and is of a size to receive the rivet with an interference fit, prior to the swaging of the rivet. Such swaging causes the rivet to bulge within the flange, thereby expanding the flange to establish and maintain a heavy interference fit between the flange and the rivet. In this way, a good, low-resistance contact between the rivet and the flange is assured, despite possible variations in the thickness of the insulating wall.

The contact plate may be formed from conductive sheet metal, such as copper. The circular flange may constitute an extrusion of the sheet metal from which the contact plate is made.

The swaging of the rivet also preferably causes the rivet to bulge within the mounting hole in the terminal bar to establish an interference fit therewith.

The head of the rivet may engage the contact plate, while the shank of the rivet may be bulged by the swaging of the rivet, so as to expand the circular flange on the contact plate.

The contact plate may have one or more contact rails, for sliding engagement by the contactor.

The switch may have a plurality of contact plates, and a plurality of contactors.

The heavy interference fit between the flange on the contact plate and the terminal rivet, due to the expansion of the flange by the bulging of the swaged rivet, gives reliable assurance that a low-resistance joint will be established and maintained between the flange and the swaged rivet, so that overheating will not occur at such joint, even when heavy currents are being carried.

BRIEF DESCRIPTION OF THE DRAWINGS

Further objects, advantages and features of the present invention will appear from the following description, taken with the accompanying drawings, in which.

DETAILED DESCRIPTION OF AN ILLUSTRATIVE EMBODIMENT

Figure 1:
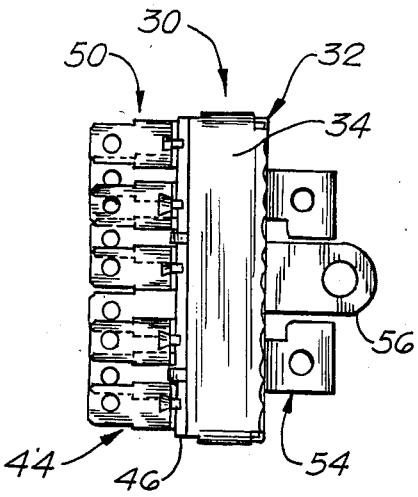
FIGS. 1, 2, 3 and 4 are side, rear, front and end views of an electrical switch to be described as an illustrative embodiment of the present invention.

As just indicated, the drawings illustrate an electrical switch 30 to be described as an illustrative embodiment of the present invention. The switch 30 is capable of many applications, but is particularly well adapted for automotive service, to control certain functions of an automotive heating and air conditioning system. The illustrated switch 30 has a casing 32 which is shown as being generally rectangular in shape. The illustrated casing 32 is made of sheet metal, but may be made of any suitable material, such as a resinous plastic material. As shown, the casing 32 has two longitudinal side walls 34 and 36, two end walls 38 and 40, and a front wall 42.

Figure 2:
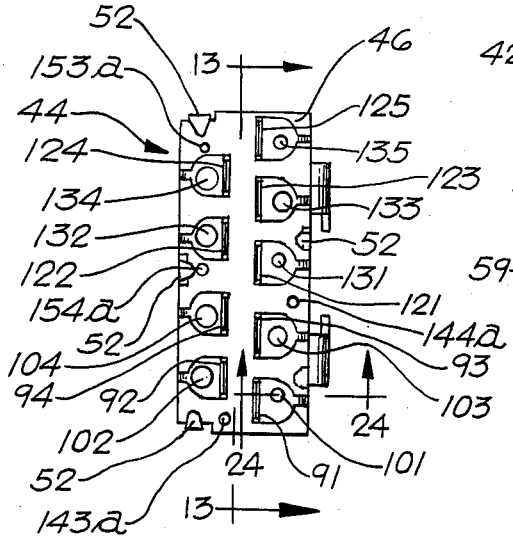
Figure 3:
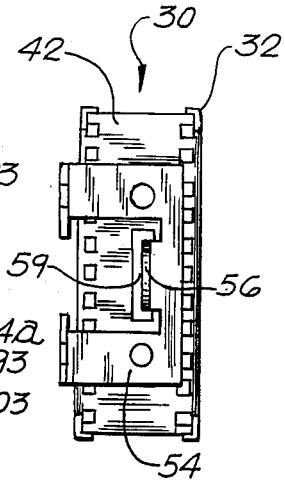
Figure 5:
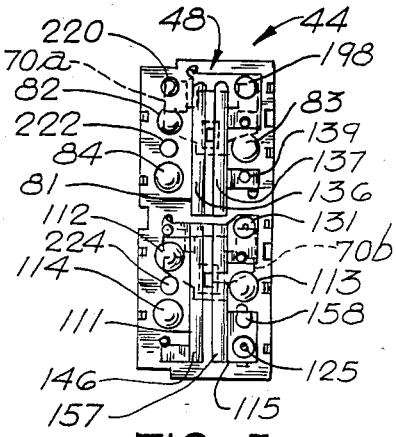
FIG. 5 is a front elevational view showing the terminal head assembly, removed from the switch, to show the layout of the fixed contact plates and the contact points, the movable contactors being shown in phantom, with broken lines.
Figure 4:
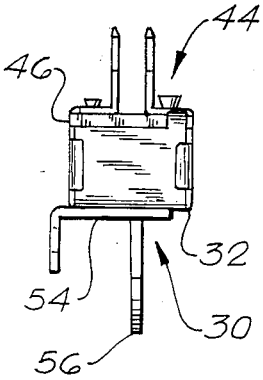
Figure 8:
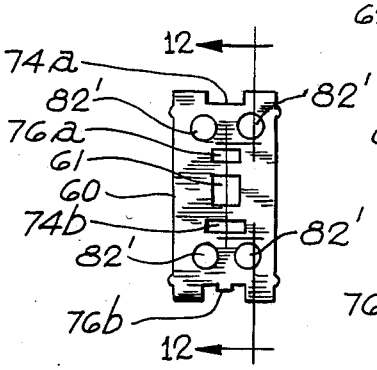
FIGS. 8, 9, 10 and 11 are rear, front, end and side views of the movable carriage.
Figure 9:
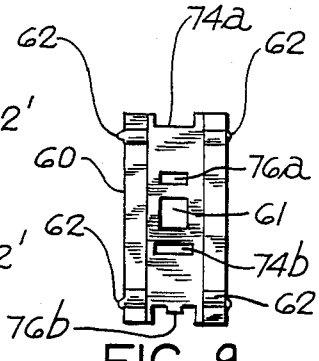

The rear side of the casing 32 is closed by an insulating plate or wall 46 which is the supporting component of a terminal head assembly 44, the rear and front sides of which are shown in FIGS. 2 and 5. The terminal head assembly 44 includes contact means 48, mounted on the front side of the insulating plate 46, as shown in FIG. 5, and terminal means 50, mounted on the rear side of the plate 46, as shown in FIGS. 1 and 2. The contact means and the terminal means will be described in greater detail presently. As shown, the insulating plate 46 is secured to the casing 32 by tabs 52, formed on the casing 32 and bent behind the insulating plate 46. It will be recognized that the insulating plate 46 forms the rear wall of the casing 32.

Figure 13:
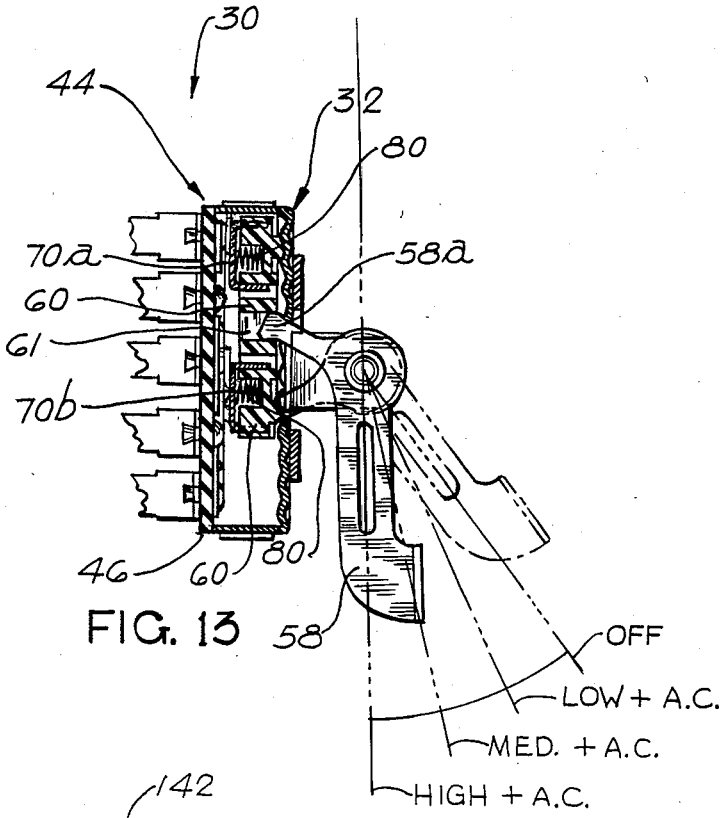
FIG. 13 is a longitudinal section, taken through the switch, generally along the line 13—13 in FIG. 2.

The front wall 42 of the casing 32 is fitted with a mounting bracket 54 which includes an arm 56 for pivotally supporting an operating lever 58, movable to a plurality of operating positions, as shown in FIG. 13. The lever 58 has an arm **58*a* which extends into the casing 32 through a slot 59 in the front wall 42**.

In this case, there are four operating positions, which are labelled in FIG. 13 as follows: OFF; LOW+A.C-.(air conditioning); MED.(medium)+A.C.; and HIGH-+A.C. From these labels, it will be understood that the switch 30 is adapted to actuate the air conditioning system, as by energizing the clutch for the air conditioning compressor, while also being adapted to energize the blower motor and to adjust the speed of the motor to low, medium or high.

As shown in FIGS. 6–12, the switch 30 has a carriage 60 which is movable longitudinally within the casing 32 and is guided for such movement by the side walls 34 and 36. The carriage 60 may be molded or otherwise formed from a resinous plastic material, or some other material which affords electrical insulation. The end walls 38 and 40 of the casing 32 act as stops to limit the longitudinal movement of the carriage 60. The arm **58*a*** of the operating lever is received in a slot 61, formed in the carriage 60.

The carriage 60 is detented in its operating positions by the interaction of detent bumps 62, projecting forwardly from the front side of the carriage, as shown in FIGS. 9–12, and detent bumps 64, projecting rearwardly from the front wall 42 of the casing 32.

Figure 6:
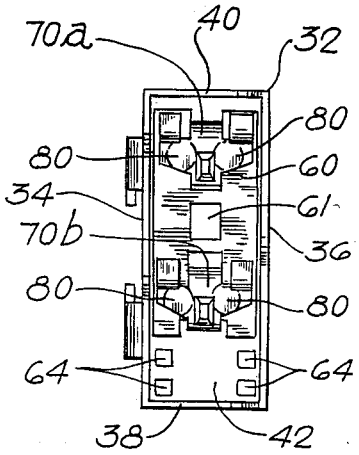
FIG. 6 is a rear elevational view showing the switch with the terminal head assembly removed, to show the contactors and the carriage, movably received within the casing.
Figure 7:
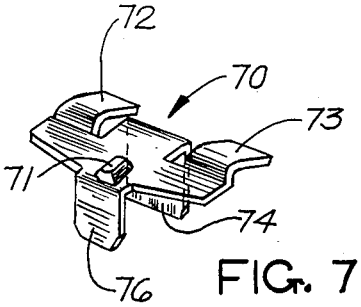
FIG. 7 is an enlarged perspective view showing one of the contactors for the switch.
Figure 10:
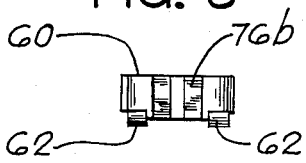
Figure 11:
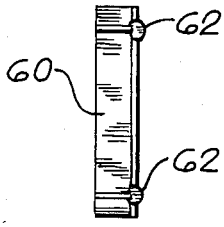
Figure 12:
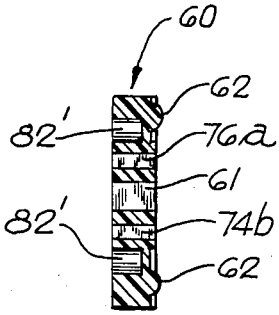
FIG. 12 is a sectional view, taken through the carriage, generally along the broken line 12—12 in FIG. 8.

In the illustrated switch 30, the carriage 60 supports contactor means, illustrated as two separate contactors 70, which may be of the same construction, as illustrated to best advantage in FIG. 7. To differentiate the two contactors, they are labelled 70*a* and 70*b* in FIGS. 5, 6 and 13. Each contactor 70 is generally in the form of a conductive metal plate, formed with three contact sliders 71, 72 and 73. The slider 71 is centrally located and is in the shape of a somewhat elongated contact rib or boss, adapted to ride smoothly between two parallel contact rails, as will be described in greater detail presently. The sliders 72 and 73 are in the shape of laterally spaced wings or humps, with gradual slopes so as to slide smoothly over contact points, as will be described in greater detail shortly. The sliders 72 and 73 are spaced laterally in opposite directions from the slider 71, and are also spaced longitudinally along the path of movement of the contactor 70 from the slider 71, so that the three sliders 71, 72 and 73 form a triangle. Thus, the sliders 71, 72 and 73 afford three points of sliding engagement with the fixed contact means of the switch, so as to stabilize the contactor 70.

To locate the contactor 70 on the carriage 60, the contactor 70 is formed with a relatively wide tab 74 and a relatively narrow tab 76, projecting generally at right angles to the basic plane of the contactor. The carriage 60 is formed with slots 74*a* and 74*b*, and also slots 76*a* and 76*b*, for slidably receiving the tabs 74 and 76 of the two contactors 70*a* and 70*b*. The slot 74*a* is relatively wide, so as to receive the relatively wide tab 74, while the slot 76*a* is relatively narrow, so as to receive the narrower tab 76, while being too narrow to receive the wider tab 74. Thus, the first contactor 70*a* is mechanically polarized on the carriage 60 in that such contactor 70*a* will fit in only one position on the carriage 60. As shown in FIG. 6, the orientation of the two contactors 70*a* and 70*b* is the same on the carriage 60 of the switch 30.

Resilient means are preferably provided between the carriage 60 and the contactors 70*a* and 70*b*, to afford a resilient biasing action therebetween. As shown in FIG. 13, such resilient biasing action is preferably provided by compression coil springs 80, adapted to be received and located in circular recesses or bores 82' formed in the carriage 60. The springs 80 are compressed between the carriage 60 and the contactors 70*a* and 70*b*, so as to bias the contactors against the contact means, while biasing the carriage 60 toward the front wall 42 of the casing 32, so as to afford resilient detenting action between the detent bumps 62 on the carriage 60 and the bumps 64 on the front wall 42.

As shown in FIG. 2, the first contactor 70*a* is selectively engageable with certain of the fixed contact means 48. Specifically, the contactor 70*a* is engageable with contact members 81–84, namely a first fixed contact plate 81 and three fixed contact points 82, 83 and 84, mounted on the front side of the insulating plate 46. The contact members 81–84 are connected to respective terminal bars or prongs 91, 92, 93 and 94, mounted on the rear side of the insulating plate 46 and projecting therefrom.

A terminal rivet 101 is preferably employed to secure the contact plate 81 and the terminal bar 91 to the opposite sides of the insulating plate 46. The contact points 82, 83 and 84 are preferably the spherically rounded heads of rivets 102, 103 and 104, employed to secure the terminal bars 92, 93 and 94 to the rear side of the insulating plate 46.

The second movable contactor 70*b* is selectively engageable with other members of the contact means 48 on the insulating plate 46. Specifically, the contactor 70*b* is engageable with contact members 111–115, namely a second contact plate 111, three contact points 112, 113 and 114, and a third contact plate 115. The contact members 111–115 are connected to respective terminal bars or prongs 121–125, mounted on the rear side of the insulating plate 46 and projecting therefrom. A terminal rivet 131 is preferably employed to connect the contact plate 111 and the terminal bar 121 to the inner and outer sides of the insulating plate 46. The contact points 112, 113 and 114 are preferably the spherically rounded heads of rivets 132, 133 and 134. A terminal rivet 135 is preferably employed to connect the contact plate 115 to the terminal bar 125.

Figure 14:
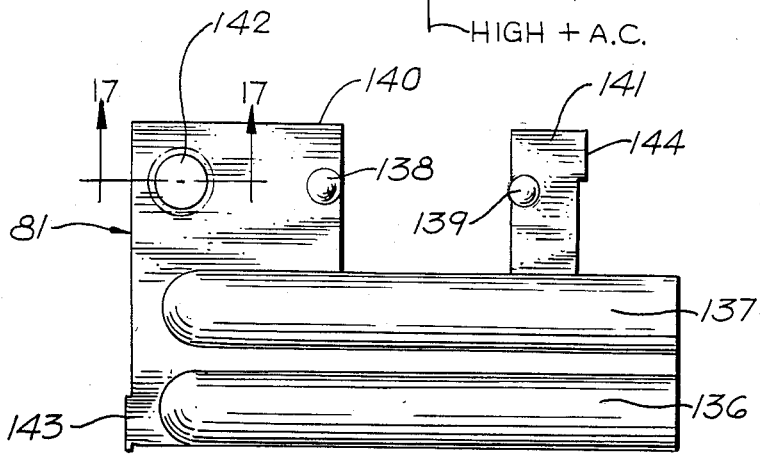
FIGS. 14, 15 and 16 are enlarged front, side and end views of one of the fixed contact plates, also shown in the upper portion of FIG. 5.
Figure 16:
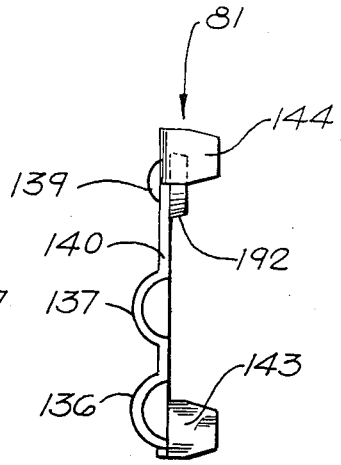
Figure 15:
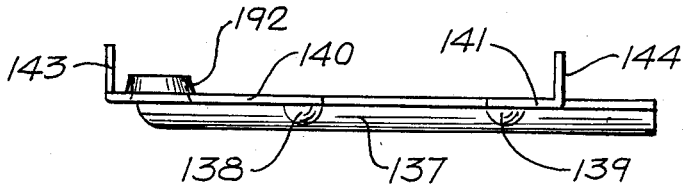

Details of the contact plate 81 are shown in the enlarged views of FIGS. 14–17. The contact plate 81 may be made of thin conductive sheet metal, such as copper, or any other known or suitable material. As shown, the contact plate 81 is formed with a pair of parallel longitudinal contact rails 136 and 137 which may be cylindrically rounded in shape, as shown in FIGS. 14 and 16. The centrally located slider 71 of the first contactor 70*a* is adapted to ride between the contact rails 136 and 137, in electrical contact with both rails. The contact plate 81 is also formed with contact points 138 and 139, positioned for engagement by the wing-shaped slider 72 of the contactor 70*a*.

The contact points 139 are formed on flat wing-like portions 140 and 141 of the contact plate 81. A mounting hole 142 is formed in the flat portion 140 of the contact plate 81, to receive the terminal rivet 101. Further details of the connection between the contact plate 81 and the terminal rivet will be described presently.

The contact plate 81 also has small locating prongs or tangs 143 and 144, projecting rearwardly therefrom, for reception in small openings 143*a* and 144*a* in the insulating plate 46.

Figure 18:
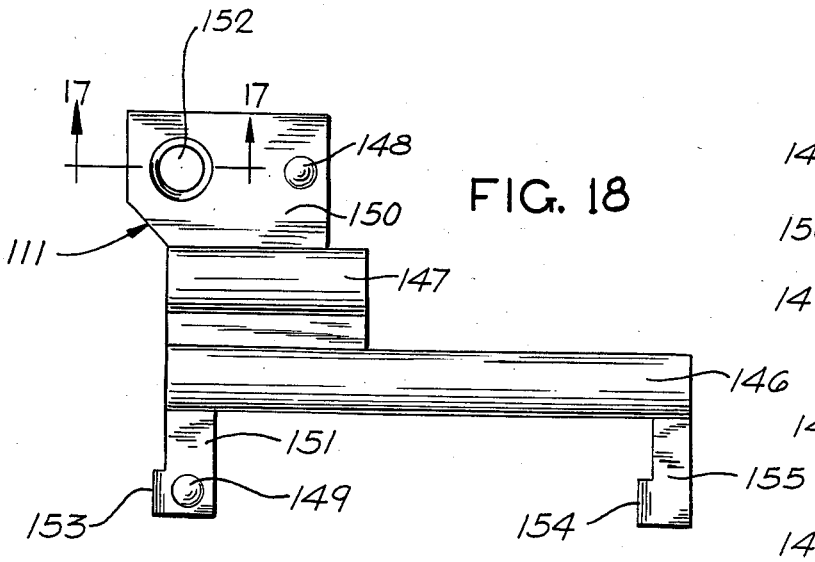
FIGS. 18, 19 and 20 are enlarged front, end and side views of a second contact plate, also shown in the lower portion of FIG. 5.
Figure 19:
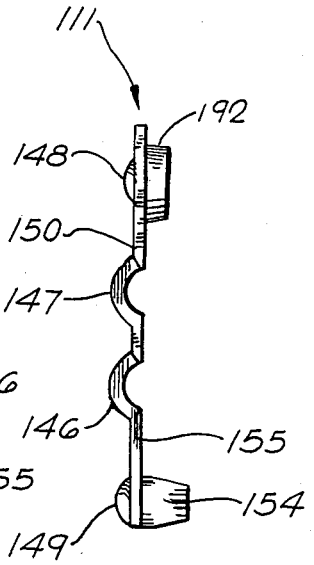
Figure 20:
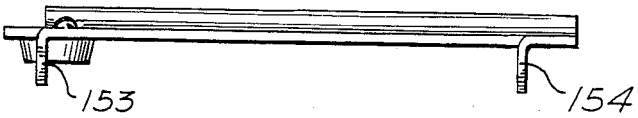

Details of the second contact plate 111 are shown in the enlarged views of FIGS. 18–20. As shown, the contact plate 111 has parallel longitudinal contact rails 146 and 147, for engagement by the centrally located slider 71 of the second contactor 70*b*. The contact rails 146 and 147 may be cylindrically curved, as shown in FIGS. 18 and 19. The plate 111 may be made of thin electrically conductive sheet metal, such as copper, or any other suitable material. The contact rails 146 and 147 are formed in one piece with the contact plate 111. In this case, the contact rail 146 is substantially longer than the contact rail 147, which parallels only a portion of the length of the rail 146. The contact plate 111 also includes contact points 148 and 149, formed on flat wing-like portions 150 and 151 of the contact plate 111. The contact points 148 and 149 are engageable by the wing-shaped sliders 72 and 73 of the second contactor 70*b*.

As shown in FIG. 18, a mounting hole 152 is formed in the flat portion 150 of the contact plate 111, to receive the terminal rivet 131. Further details of the connection between the terminal rivet 131 and the contact plate 111 will be described presently.

The contact plate 111 is also formed with small locating prongs or tangs 153 and 154, projecting rearwardly therefrom, for reception in small openings 153*a* and 154*a* in the insulating plate 46. The prong 154 is formed on a small flat wing-like tab or portion 155, projecting from the rail portion 146 of the contact plate 111.

Details of the third contact plate 115 are shown in the enlarged views of FIGS. 20–23. In this case, the contact plate 115 has a single portion formed as a contact rail 157, which may be cylindrically curved. As shown in FIG. 5, the contact rail 157 is in alignment with the contact rail 147 on the contact plate 111. However, the contact rail 157 is spaced longitudinally a short distance from the contact rail 147.

Figure 21:
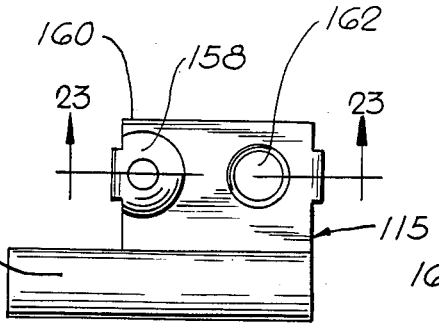
FIGS. 21 and 22 are enlarged front and end views of a third contact plate, also shown in the lower portion of FIG. 5.
Figure 22:
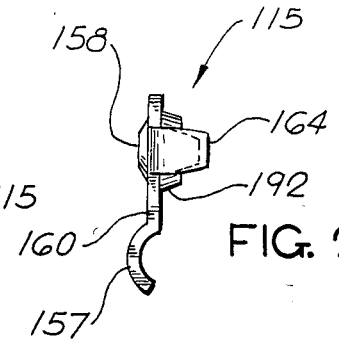
Figure 23:
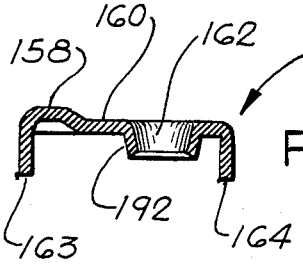
FIG. 23 is a section, taken generally along the line 23—23 in FIG. 21.

As shown in FIGS. 21–23, the third contact plate 115 is provided with a contact point 158, formed on a flat wing-like portion 160 of the plate 115, which may be formed in one piece from electrically conductive sheet metal, such as copper, or any other known or suitable material. The flat portion 160 of the contact plate 115 is also formed with a mounting hole 162, for receiving the terminal rivet 135. Further details of the connection between the terminal rivet 135 and the contact plate 115 will be described presently.

The contact plate 115 also has small locating prongs or tangs 163 and 164, projecting rearwardly therefrom, for reception in corresponding openings in the insulating plate 46. Such openings are similar to the openings 143*a* and 144*a*, previously described, but are obscured by the terminal bars 123 and 125 in FIG. 2. The locating prongs 163 and 164 extend only partway through the insulating plate 46.

Figure 17:
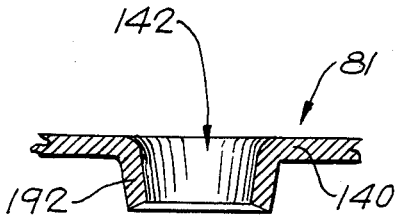
FIG. 17 is a fragmentary enlarged section, taken along the line 17—17 in either FIG. 14 or FIG. 18, and showing the circular flange for engaging the corresponding terminal rivet.
Figure 24:
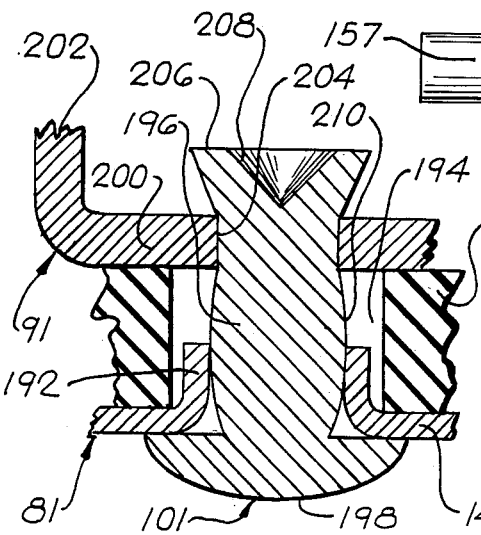
FIG. 24 is an enlarged fragmentary section, taken generally along the line 24—24 in FIG. 2, and showing one of the contact plates, the insulating plate, the corresponding terminal bar and the corresponding swaged rivet.

FIGS. 17 and 24 illustrate additional details of the connection involving the contact plate 81, the terminal rivet 101, and the terminal bar 91. Such connection is constructed and arranged to give assurance that a good, low-resistance electrical connection will be established and maintained between the contact plate 81 and the rivet 101, and also between the rivet 101 and the terminal bar 91.

The connection involving the contact plate 81, the terminal rivet 101 and the terminal bar 91 may be the same in construction as the connection involving the second contact plate 111, the terminal rivet 131 and the terminal bar 121. Moreover, the connection involving the third contact plate 115, the terminal rivet 135 and the terminal bar 125 may also be the same.

As shown in FIG. 17, the mounting hole 142 in the flat portion 140 of the contact plate 81 is preferably surrounded by a substantially circular flange 192 extruded from the flat sheet metal portion 140, or otherwise formed in one piece therewith. The circular flange 192 projects rearwardly from the flat portion 140 of the contact plate 81 and is received and located in an opening 194, formed in the insulating plate 46. The flange 192 is substantially shorter than the thickness of the insulating plate 46, so that the flange 192 projects only partway through the opening 194 in the insulating plate 46, as shown in FIG. 24.

The terminal rivet 101 preferably comprises a shank 196 with an enlarged head 198 formed at one end thereof. The rivet 101 may be made of copper or any other known or suitable material. Initially, before the rivet 101 is swaged or upset, the shank 196 is substantially cylindrical in shape. The rivet 101 may be made by feeding cylindrical copper wire into a cold heading machine, which swages or otherwise forms the head 198 and cuts off the rivet 101.

Initially, before the final swaging or upsetting of the rivet 101, the outside diameter of the shank 196 is preferably slightly larger than the inside diameter of the circular flange 192, so that there is preferably an interference fit between the rivet shank 196 and the flange 192, when the rivet is inserted through the flange. The interference fit is preferably a light interference fit, so that it is not difficult to insert the shank 196 of the rivet 101 through the circular flange 192.

The terminal bar 91 preferably has a flat mounting portion 200, adapted to engage the rear side of the insulating plate 46, and a prong portion 202, bent rearwardly from the mounting portion 200, generally at right angles thereto. As shown in FIG. 24, the mounting portion 200 is formed with a mounting hole 204, adapted to be aligned with the mounting hole 142 and the circular flange 192 on the contact plate 81.

In the assembly of the switch, the circular flange 192 is inserted into the opening 194 in the insulating plate 46. The shank 196 of the rivet 101 is then inserted through the circular flange 192, the opening 194, and the mounting hole 204 in the terminal bar 91. The head 198 of the rivet 101 preferably engages the flat portion 140 of the contact plate 81.

The rivet 101 is then swaged or upset by applying a high compressive force between the rivet head 198 and the end 206 of the shank 196, with a swaging tool which produces a conical depression 208 in the end 206. The swaging causes the shank 196 of the rivet 101 to bulge outwardly. Thus, it will be seen from FIG. 24 that the shank 196 of the swaged rivet 101 has an outwardly bulging barrel-shaped portion 210 which expands the circular flange 192, so that a heavy interference fit is produced between the flange 192 and the bulging shank portion 210. This heavy interference fit assures that good, low-resistance electrical contact will be established and maintained between the circular flange 192 and the rivet shank 196. Initially, the circular flange 192 is preferably tapered, as shown in FIG. 17, so that its rear portion, remote from the flat portion 140 of the contact plate 81, is tapered to a smaller inside diameter than the inside diameter of the front or entrance end of the flange 192. When the rivet 101 is swaged, the bulging portion 210 of the rivet shank 196 expands the tapered flange 192, so that it preferably becomes approximately cylindrical or even slightly flaring in shape, as shown in FIG. 24.

The swaging of the rivet 101 also causes the shank 196 to bulge within the mounting hole 204 in the terminal bar 91, so as to establish and maintain an interference fit between the shank 196 and the mounting hole 208. This interference fit assures that a good, low-resistance electrical contact will be established and maintained between the rivet shank 196 and the terminal bar 91.

The swaging of the rivet 101 also produces a clamping force, whereby the rivet 101 clamps the contact plate 81 and the terminal bar 91 against the front and rear sides of the insulating plate 46. However, unlike prior constructions, the clamping action is not relied upon to establish and maintain good electrical contact between the rivet 101 and the contact plate 81. Rather, the establishment and maintenance of such good electrical contact is assured by the heavy interference fit which is developed between the bulged shank portion 210 and the circular flange 192 on the contact plate 81. This heavy interference fit between the bulged shank portion 210 and the expanded flange 192 insures that good, low-resistance electrical contact will be maintained therebetween, even if the clamping action between the rivet head 198 and the contact plate 81 is initially inadequate or becomes inadequate, due to dimensional variations in the thickness of the insulating plate 46, or due to changes in temperature and humidity.

The above description of the connection involving the contact plate 81, the terminal rivet 101 and the terminal bar 91 also applies to the connection involving the second contact plate 111, the terminal rivet 131 and the terminal bar 121, and the connection involving the third contact plate 115, the terminal rivet 135 and the terminal bar 125. In each case, the swaging of the rivet produces a bulged shank portion 210 which expands the circular flange 192 and establishes a heavy interference fit therebetween, to insure the establishment and maintenance of a good, low-resistance electrical joint. Moreover, in each case, the rivet shank 196 bulges into the mounting hole 204 in the terminal bar, to establish an interference fit therebetween, whereby a low-resistance electrical joint is established and maintained.

In the operation of the switch 30, the first contact plate 81 is generally connected to the battery circuit by way of the terminal bar 91. The contact points 82, 83 and 84 are connected to the low, medium and high speed connections of the blower motor circuit, by way of the terminal bars 92, 93 and 94.

The second contact plate 111 is also generally connected to the battery circuit, by way of the terminal bar 121. The contact points 112, 113 and 114 are connected to the low, medium and high speed connections of a blower motor circuit, by way of the terminal bars 122, 123 and 124. The third contact plate 115 is generally connected to an air conditioning clutch circuit, by way of the terminal bar 125. The connections to the terminal bars or prongs 91–94 and 121–125 are generally established by an electrical plug or connector.

In all of the operating positions of the switch carriage 60, the centrally located slider 71 of the first contactor **70*a* engages the contact rails 136 and 137 of the first contact plate 81, so that the contactor is always connected to the battery circuit. In the OFF position of the switch, the wing-shaped sliders 72 and 73 of the first contactor 70*a* engage only the rivet head 198 and an insulating boss 220 on the insulating plate 46, so that no circuit is established. The insulating boss 220 stabilizes the contactor 70*a*** by providing a third point of mechanical contact therewith, so as to prevent the contactor from rocking.

In the LOW position of the first contactor **70*a*, the slider 73 engages the contact point 82, while the slider 72 engages the contact point 148 on the contactor plate 81**, to stabilize the contactor. Thus, the low speed connection of the blower circuit is connected to the battery.

In the MED. position of the first contactor **70*a*, the slider 72 engages the contact point 83, while the slider 73 engages an insulating boss 222 on the insulating plate 46, to stabilize the contactor 70*a*** against rocking movement. Thus, the medium speed connection of the motor circuit is connected to the battery.

In the HIGH position of the first contactor **70*a*, the slider 73 engages the contact point 84, while the slider 72 engages the contact point 139 on the contact plate 81**, to stabilize the contactor against rocking movement. Thus, the high speed connection of the motor circuit is connected to the battery.

In all of the operating positions of the second contactor **70*b*, the slider 71 engages the longer contact rail 146 of the second contact plate 111, so that the contactor is always connected to the battery circuit. In the OFF position of the second contactor 70*b*, the central rider 71 also engages the shorter contact rail 147 of the contact plate 111. The slider 72 and 73 of the second contactor 70*b* engage the rivet 131 and the contact point 149**, so that no circuit is established.

In the other three positions of the second contactor **70*b*, designated LOW, MED. and HIGH, the slider 71 of the second contactor 70*b* engages the contact rail 157 of the third contact plate 115**, so as to energize the air conditioning clutch, whereby the air conditioning compressor is operated.

In the LOW position of the second contactor **70*b*, the slider 73 engages the contact point 112, while the slider 72 engages the stabilizing contact point 148**. Thus, the low speed connection of the motor circuit is energized.

In the MED. position of the second contactor **70*b*, the slider 72 engages the contact point 113, while the slider 73 engages an insulating boss 224 on the insulating plate 46**, to stabilize the second contactor against rocking movement. Thus, the medium speed connection of the motor circuit is connected to the battery.

In the HIGH position of the second contactor **70*b*, the slider 73 engages the contact point 114, while the wing 72 engages the stabilizing contact point 158 on the third contact plate 115**. Thus, the high speed connection of the motor circuit is connected to the battery.

We claim:

1. An electrical switch, comprising a casing, a carriage movable in the casing along a predetermined path, at least one conductive contactor mounted on the carriage for movement therewith along such path, an insulating plate mounted on the casing and forming one wall thereof parallel with such path, such plate having inner and outer sides, contact means mounted on the inner side of such insulating plate and selectively engageable by the contactor, and terminal means connected to the contact means and projecting outwardly from the outer side of the insulating plate, such contact means including at least one conductive contact plate having a substantially circular mounting hole therein with a substantially circular flange surrounding such mounting hole and formed in one piece with such contact plate, such insulating plate having an opening therein for receiving such flange, such terminal means including a terminal bar engaging the outer side of the insulating plate and having a mounting hole aligned with the mounting hole in the contact plate, and a rivet for connecting the terminal bar to the contact plate with the insulating plate secured therebetween, such rivet extending through the circular flange of the contact plate with an interference fit to establish and maintain good electrical contact therewith, the rivet also extending through the opening in the insulating plate and the mounting hole in the terminal bar and being swaged to establish and maintain good electrical contact with the terminal bar as well as the circular flange of the contact plate.

2. An electrical switch according to claim 1,
in which the circular flange of the contact plate is initially tapered to receive the rivet with an interference fit prior to the swaging of the rivet,
the swaging of the rivet causing it to bulge within the flange,
thereby expanding the flange to establish and maintain a heavy interference fit between the flange and the rivet.

3. An electrical switch according to claim 1,
in which the rivet has a head engaging the contact plate and a shank extending through the circular flange,
the circular flange being initially tapered to receive the shank with an interference fit prior to the swaging of the rivet,
the swaging of the rivet causing the shank of the rivet to bulge within the flange,
thereby expanding the flange to establish and maintain a heavy interference fit between the flange and the shank of the rivet.

4. An electrical switch according to claim 3,
in which the shank of the rivet is also caused to bulge within the mounting hole in the terminal bar by the swaging of the rivet,
whereby an interference fit is also produced between the shank of the rivet and the mounting hole in the terminal bar.

5. An electrical switch, comprising
a casing having an open side,
a carriage movable in the casing along a predetermined path,
at least one conductive contactor mounted on the carriage for movement therewith along such path,
an insulating plate mounted on the casing and forming a wall thereof parallel with such path and closing the open side of the casing,
such plate having inner and outer sides,
contact means mounted on the inner side of such insulating plate and selectively engageable by the contactor,
and terminal means connected to the contact means and projecting outwardly from the outer side of the insulating plate,
such contact means including at least one conductive contact plate engaging the inner side of the insulating plate and having a contact rail extending along at least a portion of the path of the contactor,
such contactor being slidably engageable with such contact rail,
such contact plate having a substantially circular mounting hole therein with a substantially circular flange surrounding such mounting hole and formed in one piece with such contact plate,
such insulating plate having an opening therein for receiving such flange,
such terminal means including a terminal bar engaging the outer side of the insulating plate and having a mounting hole aligned with the mounting hole in the contact plate,
and a rivet for connecting the terminal bar to the contact plate with the insulating plate secured therebetween,
such rivet having a shank extending through the circular flange of the contact plate with an interference fit to establish and maintain good electrical contact therewith,
the shank of the rivet also extending through the opening in the insulating plate and the mounting hole in the terminal bar,
the rivet being swaged to establish and maintain good electrical contact with the terminal bar as well as the circular flange of the contact plate.

6. An electrical switch according to claim 5,
in which the circular flange of the contact plate is initially tapered to receive the shank of the rivet with an interference fit prior to the swaging of the rivet,
the swaging of the rivet causing the shank to bulge within the flange,
thereby expanding the flange to establish and maintain a heavy interference fit between the flange and the shank of the rivet.

7. An electrical switch according to claim 6,
such rivet having a head for engaging the contact plate,
the swaging of the rivet also causing the shank to bulge within the hole in the terminal bar to establish and maintain an interference fit therewith.

8. An electrical switch according to claim 5,
the swaging of the rivet causing the shank of the rivet to bulge within the circular flange of the contact plate,
thereby expanding the flange to establish and maintain a heavy interference fit between the flange and the shank of the rivet.

9. An electrical switch according to claim 8,
the rivet having a head engaging the contact plate,
the swaging of the rivet also causing the shank of the rivet to bulge within the mounting hole in the terminal bar to establish an interference fit therewith.

10. An electrical switch, comprising
a casing having at least one insulating wall,
a carriage movable in the casing along a predetermined path generally parallel with such insulating wall,
at least one conductive contactor mounted on the carriage for movement therewith along such path,
such insulating wall having inner and outer sides,
contact means mounted on the inner side of such insulating wall and selectively engageable by the contactor,
and terminal means connected to the contact means and projecting outwardly from the outer side of the insulating wall,
such contact means including at least one conductive contact plate engageable by the contactor and having a substantially circular mounting hole in the plate with a substantially circular flange surrounding such mounting hole and formed in one piece with such contact plate,
such insulating wall having an opening therein for receiving such flange,
such terminal means including a terminal bar engaging the outer side of the insulating wall and having a mounting hole aligned with the mounting hole in the contact plate,
and a rivet for connecting the terminal bar to the contact plate while securing the contact plate and the terminal bar to the inner and outer sides of the insulating wall,
such rivet extending through the circular flange of the contact plate with an interference fit to establish and maintain good electrical contact therewith, the rivet also extending through the opening in the insulating wall and the mounting hole in the terminal bar and being swaged to establish and maintain good electrical contact with the terminal bar as well as the circular flange of the contact plate.

11. An electrical switch according to claim 10,
in which the circular flange of the contact plate is initially tapered to receive the rivet with an interference fit prior to the swaging of the rivet,
the swaging of the rivet causing it to bulge within the flange,
thereby expanding the flange to establish and maintain a heavy interference fit between the flange and the rivet.

12. An electrical switch according to claim 11,
in which the swaging of the rivet also causes the rivet to bulge within the mounting hole in the terminal bar to establish an interference fit therewith.

13. An electrical switch according to claim 12,
in which the rivet has a shank and a head,
the head engaging the contact plate,
the shank of the rivet being bulged by the swaging of the rivet.

14. An electrical switch according to claim 10,
the swaging of the rivet causing it to bulge within the flange,
thereby expanding the flange to establish and maintain a heavy interference fit between the flange and the rivet.

15. An electrical switch according to claim 14,
in which the swaging of the rivet also causes bulging of the rivet within the mounting hole in the terminal bar to establish an interference fit therewith.

16. An electrical switch according to claim 15,
in which the rivet includes a head and a shank,
the head engaging the contact plate,
the shank being bulged by the swaging of the rivet.

* * * * *